US005088541A

United States Patent [19]

Persing et al.

[11] Patent Number: 5,088,541

[45] Date of Patent: Feb. 18, 1992

[54] SPACE DIVIDING PANEL SYSTEM WITH COUNTER CAP

[75] Inventors: Brian J. Persing, Northgate; John P. Connor, Jamestown Township, Ottawa County, both of Mich.

[73] Assignee: Westinghouse Electric Corp., Pittsburgh, Pa.

[21] Appl. No.: 680,874

[22] Filed: Apr. 5, 1991

[51] Int. Cl.[5] ..... E04B 2/74

[52] U.S. Cl. ..... 160/135; 52/239

[58] Field of Search ..... 160/135, 351, 229.1; 52/239, 238.1, 241, 242, 243

[56] References Cited

U.S. PATENT DOCUMENTS

| | | | |
|---|---|---|---|
| 3,430,997 | 3/1969 | Propst et al. | 52/239 X |
| 3,987,836 | 10/1976 | LeMay | 160/135 |
| 4,047,342 | 9/1977 | Boulva | 160/351 X |
| 4,104,838 | 8/1978 | Hage et al. | 160/135 X |
| 4,458,461 | 7/1984 | Holley | 52/239 |
| 4,567,698 | 2/1986 | Morrison | 52/239 X |
| 4,631,881 | 12/1986 | Charman | 160/135 X |
| 4,716,699 | 1/1988 | Crossman et al. | 52/239 |
| 4,719,731 | 1/1988 | Ravotti et al. | 52/239 |
| 4,947,601 | 8/1990 | McGuire | 52/239 |
| 4,993,205 | 2/1991 | Dull et al. | 52/239 X |

*Primary Examiner*—David M. Purol
*Attorney, Agent, or Firm*—D. R. Lackey

[57] ABSTRACT

A space dividing panel system having a plurality of panels. Slotted standards are disposed between adjacent panels, with each slotted standard having first and second vertical rows of slots respectively accessible from opposite sides of the panels. A counter cap is disposed in spaced relation above an upper edge of a panel, supported by at least one support assembly. The upper edge of the panel includes an upwardly open wire trough. The support assembly includes first and second bracket members respectively supported by the first and second vertical rows of slots. A third bracket member is fixed to the first and second bracket members, and the counter cap is fixed to the third bracket member. The spaced relation between the counter cap and the upper edge of the wire trough provides access to the wire trough without disturbing the support assembly or counter cap.

7 Claims, 5 Drawing Sheets

SPACE DIVIDING PANEL SYSTEM WITH COUNTER CAP

TECHNICAL FIELD

The invention relates in general to open plan office space dividing partition systems, and more specifically to such systems having a counter cap.

BACKGROUND ART

Most office space dividing panel or partition systems offer a relatively narrow work surface which is mounted directly on the upper edge of a short panel, e.g., 36" to 42" high, to allow transactions to be conducted between personnel on opposite sides of the panel. These narrow work surfaces, hereinafter called "counter caps", are usually planned into secretarial, clerical and receptionist work stations. Counter caps of which I am aware are at least partially supported by brackets called "counter cap cantilevers", with the cantilevers engaging slots in the slotted standards of the panels. The counter cap, while mainly supported by the brackets, is substantially flush with the top of the partition, and gains some support through this arrangement.

With the increased requirements for electrical power and communications cables in space dividing office panel systems, such systems are now commonly providing a relatively large wire trough accessible along the upper edge of a panel. Ready access to the wire trough is hindered by the counter cap, which must be dismantled when such access is required.

It would be desirable, and it is an object of the invention, to provide a new counter cap arrangement which accommodates upper edge wire troughs, enabling wires and cables to be placed in, and removed from, an upper edge wire trough without disturbing a counter cap. This must be accomplished without sacrificing stability and structural integrity of the counter cap.

SUMMARY OF THE INVENTION

Briefly, the present invention is a new space dividing panel system which has a counter cap structure which permits access to a wire trough which extends along the upper edge of the panel system. The counter cap is supported in spaced relation above the upper edge of a panel, or panels, by a support assembly which provides cantilevered support surfaces on opposite sides of a panel. The number of such support assemblies depends upon the length of the counter cap. The support assemblies, notwithstanding the fact that the counter cap is spaced above the upper edge of the associated panel, or panels, provide rigid, stable support for the associated counter cap, while automatically achieving accurate positioning thereof.

More specifically, the support assembly includes first and second elongated bracket members having first and second ends, and a third bracket member. The first and second bracket members each include mounting means in the form of an L-shaped clip having hook-shaped connectors which engage slots in a slotted standard. The first and second bracket members engage slots on opposite sides of a slotted standard, which are accessible from opposite sides of the associated panel or panels. The hook-shaped connectors start near the lower or first ends of the first and second bracket members, with the second ends of the first and second bracket members extending upwardly, well above the upper edge of the associated panel or panels.

The third bracket member is firmly supported on upper flat surfaces which define the second ends of the first and second bracket members. The first and second vertically oriented bracket members are fixed to the horizontally oriented third bracket member via a plurality of fasteners, such as screws, and a counter cap is fixed to said horizontally oriented third bracket member via suitable fasteners, such as screws.

BRIEF DESCRIPTION OF THE DRAWINGS

The invention will become more apparent by reading the following detailed description in conjunction with the drawings which are shown by way of example only, wherein.

DESCRIPTION OF PREFERRED EMBODIMENTS

Figure 1:
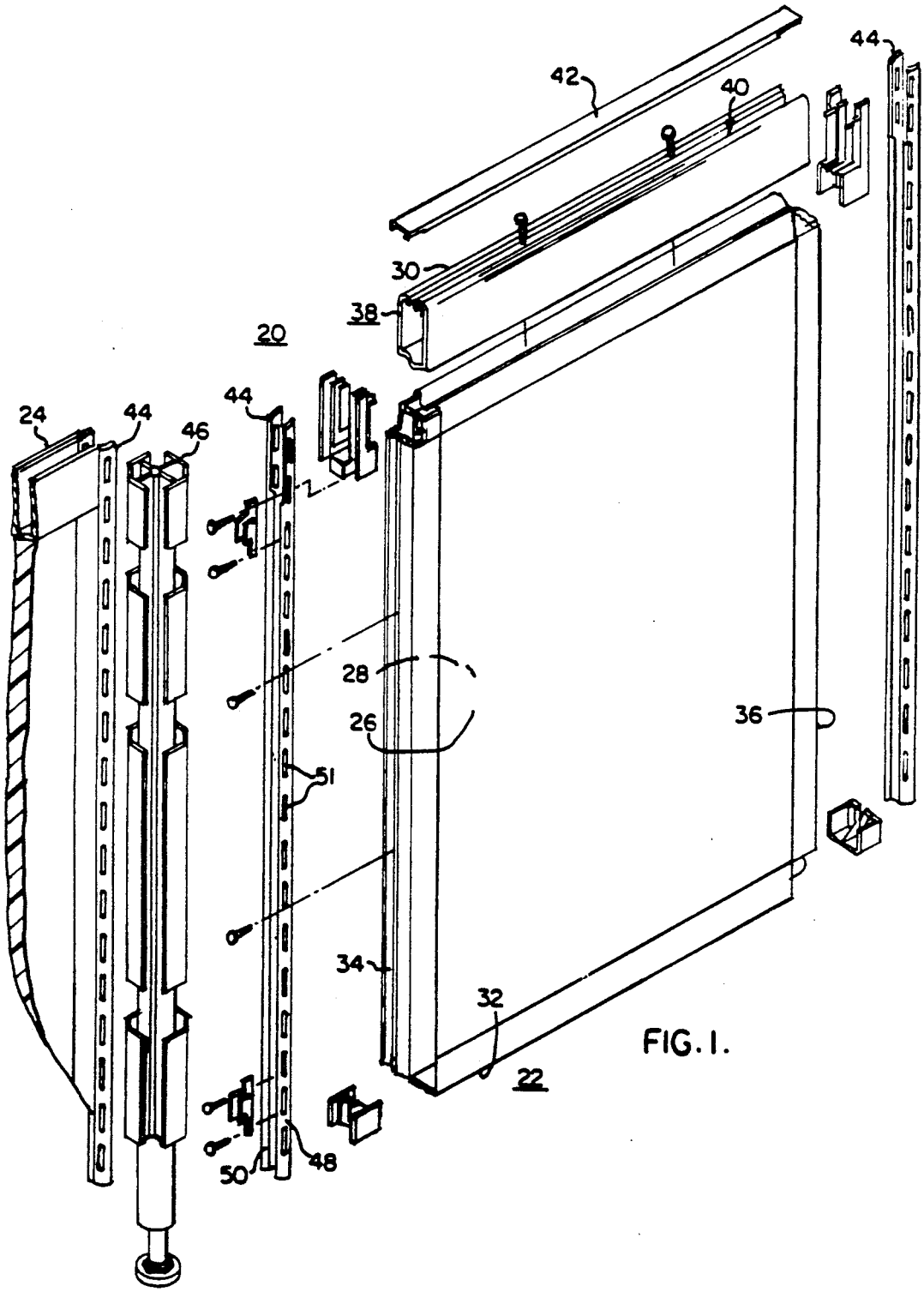
FIG. 1 is an exploded perspective view of a space dividing panel system which may be provided with a counter cap assembly constructed according to the teachings of the invention.

Referring now to the drawings, and to FIG. 1 in particular, there is shown an office space dividing panel system 20 of the type which may utiiize the counter cap assembly of the invention. The space dividing panel system 20 is shown and described in detail in co-pending application Ser. No. 07,523,772, and in Ser. No. 07,523,773, now U.S. Pat. No. 5,033,526, both filed May 15, 1990, which are assigned to the same assignee as the present application, and thus system 20 will only be described to the extent necessary to understand the present invention.

More specifically, space dividing panel system 20 includes a plurality of partitions or panels, such as panels 22 and 24, with each panel, such as panel 22, having first and second opposed major sides or surfaces 26 and 28. Panel 22 has an outer periphery which includes upper and lower edges 30 and 32, respectively, and first and second vertically oriented side edges 34 and 36. The upper edge 30 is defined by a wire trough 38 which is accessible from above via an elongated opening 40. A decorative panel cap 42 fits into and conceals opening 40, with the panel cap 42 being removable when access is desired for laying in, or removing, electrical cables and/or communications cables.

Slotted standards 44 are provided between vertical edges of adjacent panels, such as between panels 22 and 24, with a slotted standard 44 being commonly attached to each vertical edge 34 and 36 of a panel. Adjacent panels are joined by any suitable means. For example, the panels may be joined by supporting them on a common post 46, as illustrated; or, they may be directly joined by clamping arrangements, hinges, and the like. Each slotted standard 44 has first and second vertical rows 48 and 50 of slots 51, with the first and second vertical rows 48 and 50 being accessible from opposite sides of the associated panel or panels, i.e., from the sides of their major surfaces 26 and 28.

Figure 2:
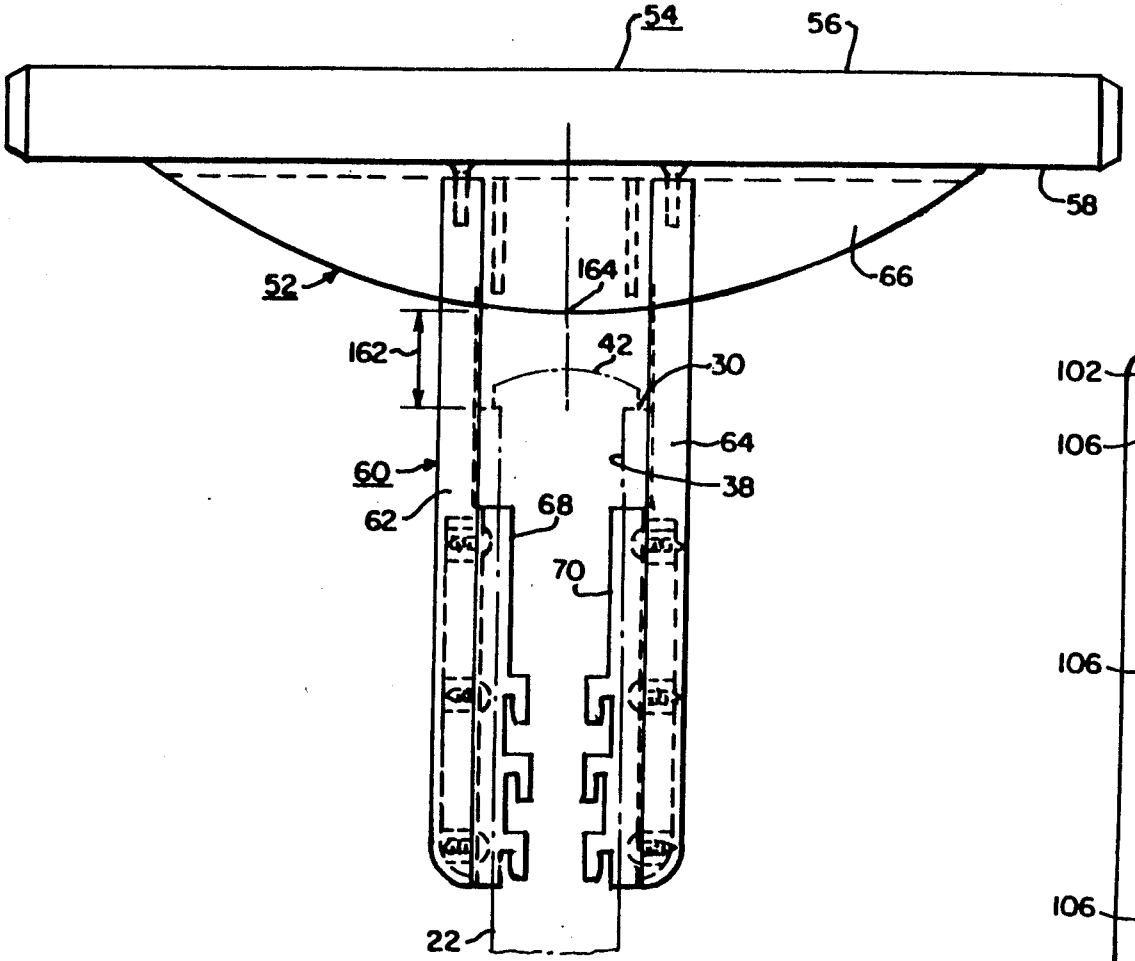
FIG. 2 is an end view of a counter cap assembly constructed, according to the invention, with the associated panel system being shown in phantom.

FIG. 2 is an end elevational view of a counter cap assembly 52 constructed according to the teachings of the invention, with counter cap assembly 52 being shown supported by panel system 20, such as by panel 22, which is shown in phantom. Counter cap assembly 52 includes a counter cap 54 which is a relatively narrow work surface having upper and lower surfaces 56 and 58, respectively. The view of counter cap 54 in FIG. 2 illustrates a typical relatively narrow width, with the length being any desired value. Counter cap 54 is supported by a predetermined number of horizontally spaced support assemblies, such as support assembly 60, with the number being determined by the length of the counter cap 54.

Figure 3:
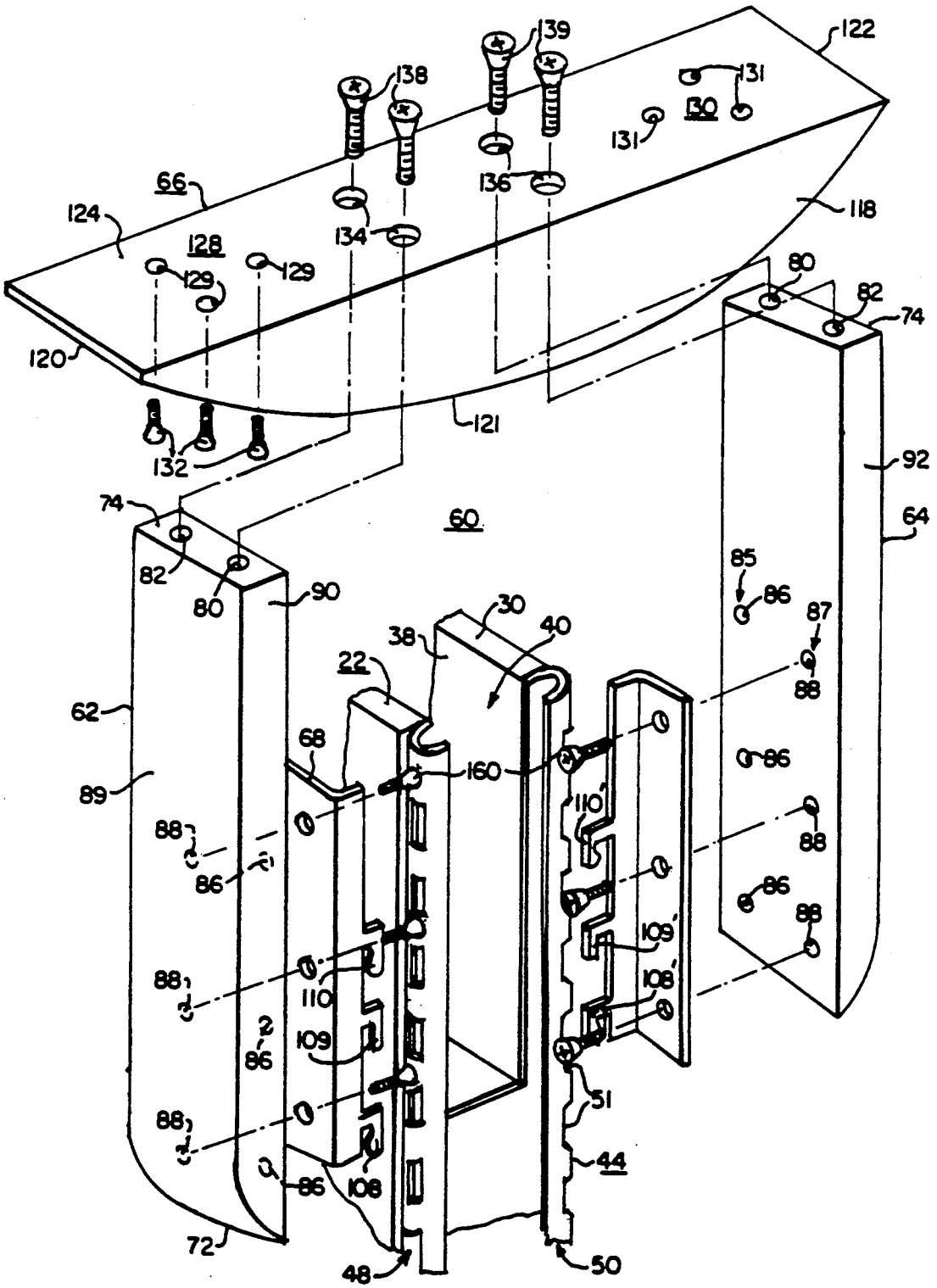
FIG. 3 is an exploded perspective view of the counter cap support assembly shown in FIG. 2.

As illustrated in FIG. 2, and also more clearly in an exploded perspective view in FIG. 3, support assembly 60 includes first and second bracket members 62 and 64 which are of like construction, and a third bracket member 66. The first and second bracket members 62 and 64 include mounting means, such as first and second mounting clips 68 and 70, for mounting the first and second bracket members 62 and 64 to a slotted standard 44. As will be hereinafter explained, the mounting clips 68 and 70 are also of like construction. Thus, outside of fasteners, such as screws, support assembly requires only three different piece parts, and only five total pieces.

Figure 6:
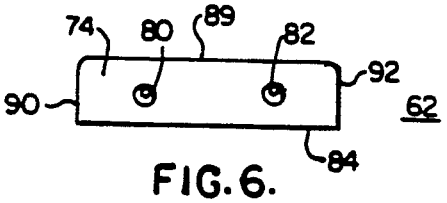
FIG. 6 is a plan view of the bracket member shown in FIG. 4.
Figure 4:
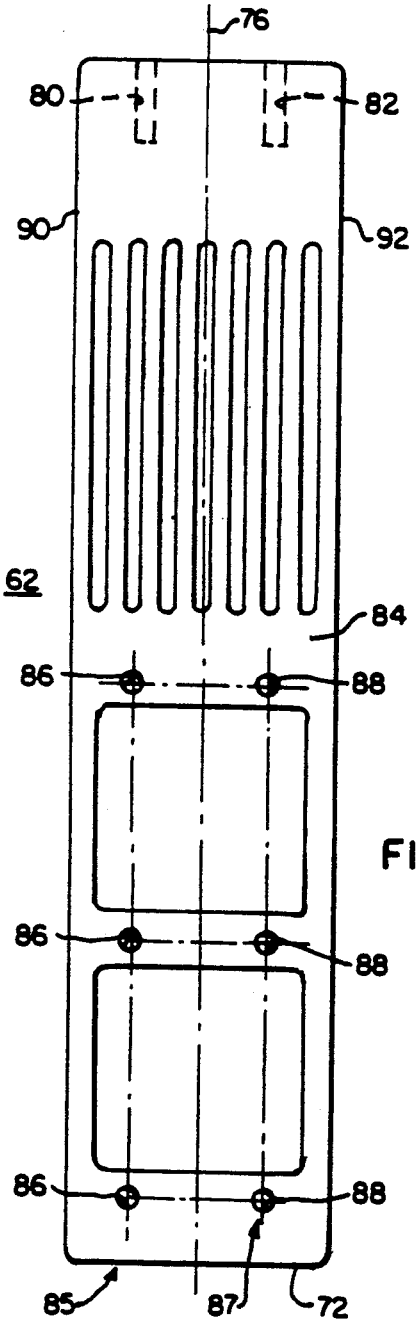
FIG. 4 is a front elevational view of one of the vertically oriented bracket members shown in FIGS. 2 and 3.
Figure 5:
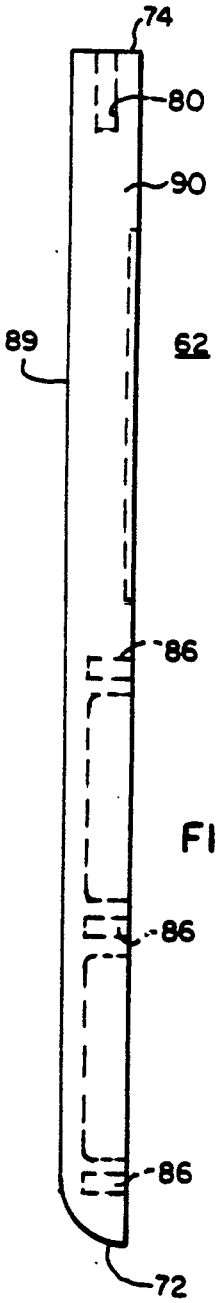
FIG. 5 is a side elevation of the bracket member shown in FIG. 4.
Figure 13:
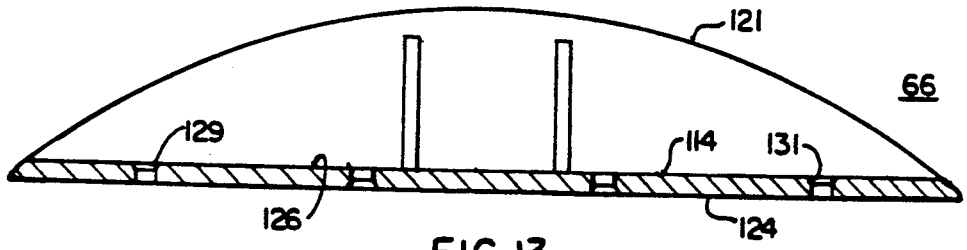
FIG. 13 is a sectional view of the bracket member shown in FIG. 11, taken between and in the direction of arrows 13—13.
Figure 11:
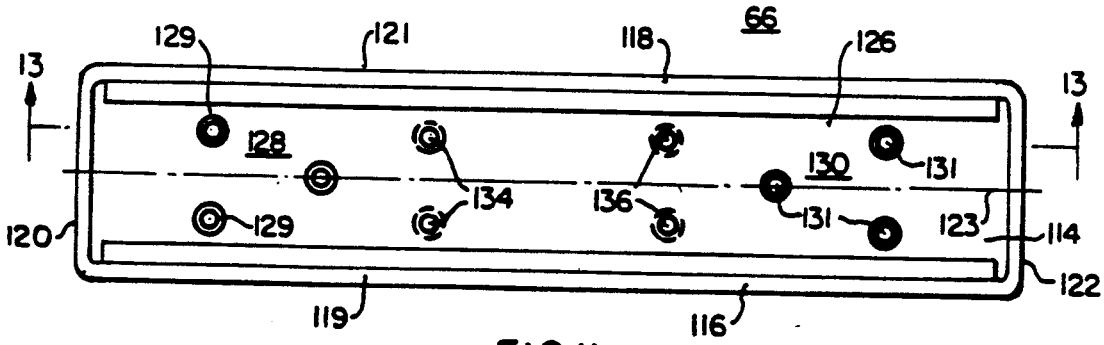
FIG. 11 is a bottom view of the bracket member shown in FIG. 11.
Figure 10:
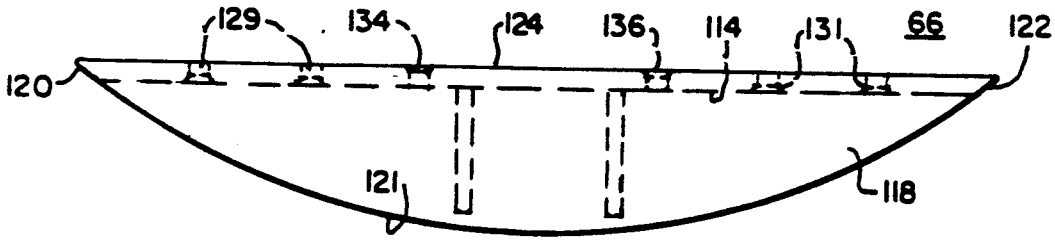
FIG. 10 is a side elevational view of the horizontally oriented bracket member shown in FIGS. 2 and 3.
Figure 12:
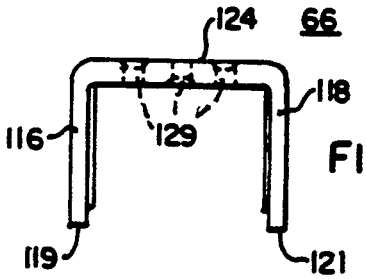
FIG. 12 is an end elevational view of the bracket member shown in FIG. 10.

FIGS. 4, 5 and 6 illustrate front, side and plan views of one of the identical first and second bracket members, such as bracket member 62, for example. Bracket member 62 is an elongated structure constructed of a light but strong material, such as aluminum, having first and second ends 72 and 74, with a longitudinal axis 76 extending between the ends. The second end 74 defines a flat support surface having openings 80 and 82 for receiving suitable fasteners, such as screws. Bracket member 62 includes a relatively large flat inner side or surface 84 which faces the associated panel 22. Side 84, which may be ornamented, as illustrated, has a first vertical column 85 of spaced openings 86, and a second vertical column 87 of spaced openings 88. Bracket member 62 further includes an outer side 89 which is flat until curving inwardly at the first end 72 to join the inner surface 84. Finally, bracket member 62 has first and second opposed flat lateral sides 90 and 92 which join the inner and outer sides 84 and 89.

Figure 7:
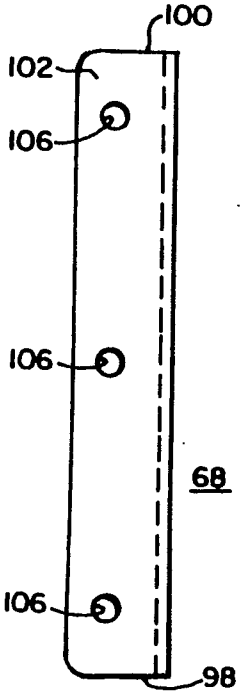
FIG. 7 is a rear elevational view of a mounting clip used to mount the bracket member shown in FIGS. 2–6 to a slotted standard of a panel.
Figure 8:
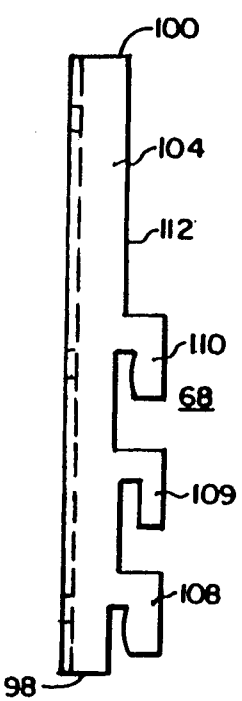
FIG. 8 is a side elevational view of the mounting clip shown in FIG. 7.
Figure 9:
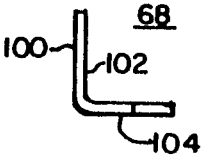
FIG. 9 is a plan view of the mounting clip shown in FIG. 7.

FIGS. 7, 8 and 9 illustrate back, side and plan views of one of the identical mounting clips 68 or 70, such as mounting clip 68. Mounting clip 68 is an elongated member constructed of a strong material, such as cold rolled steel, having first and second ends 98 and 100. Mounting member 68 has a substantially L-shaped configuration, including first and second leg portions 102 and 104 disposed at right angles. The first leg portion 102 includes a plurality of vertically spaced openings 106. Leg portion 104 includes a plurality of hook-like connectors 108, 109 and 110 which start near the first end 98, and are spaced upwardly such that they extend to near the mid-point of mounting member 68, between the first and second ends 98 and 100. Connectors 108, 109 and 110 extend outwardly from edge 112 of the second leg portion 104.

FIGS. 10, 11, 12, and 13 illustrate side, bottom, end, and sectional views of the third bracket member 66. Bracket member 66, which may be formed of metal or a high strength plastic, has a substantially U-shaped or channel shaped cross sectional configuration, including a bight 114 and first and second depending leg portions 116 and 118. Bracket member 66 is elongated, having first and second ends 120 and 122, and a longitudinal axis 123 which extends between ends 120 and 122.

Bight 114 includes a flat upper or top surface 124 and a lower surface 126. Bight 114 includes a first group 128 of openings 129 near the first end 120, and a second group 130 of openings 131 adjacent to the second end 122, for receiving suitable fasteners, such as screws 132 shown in FIG. 3. Screws 132 attach each support assembly 60 to counter cap 54. Bight 114 further includes first and second pairs of openings 134 and 136 for respectively receiving screws 138 an 139. Screws 138 and 139 fix the third bracket member 66 to the first and second bracket members 62 and 64 via openings 80 and 82 in the second or upper ends 74 of the bracket members.

The first and second leg portions 116 and 118 are preferably terminated at their lower ends with curved surfaces or edges 119 or 121, respectively, such as by forming the lower ends of the leg portions 116 and 118 to define a crescent shape, such as portions of circles having like radii.

In the assembly of support assembly 60, most clearly shown in FIG. 3, the first and second mounting clips 68 and 70 are respectively firmly attached to the first and second bracket members 62 and 64 via suitable fasteners, such as screws 160. The first and second bracket members 62 and 64 are then attached to a slotted standard 44, with hooks 108, 109 and 110 of mounting clip 68 entering predetermined slots 51 of the first row 48 of slots, and with hooks 108, 109 and 110 of mounting clip 70 entering predetermined slots 51 of the second row 50 of slots. The predetermined slots engaged by the hooks 108, 109 and 110 are selected to provide a desired clearance dimension 162 between the top or upper edge 30 of the wire trough 38 and the closest edges 164 of the curved terminations 119 and 121 of the first and second leg portions 116 and 118 of the third bracket member 66.

The first and second bracket members 62 and 64 are then held in vertical positions while the third bracket member 66 is placed on the upper ends 74 of the first and second bracket members 62 and 64. Screws 138 and 139 are inserted through openings 134 and 136 in the third bracket member 66 and they threadably engage openings 80 and 82 in the upper ends 74 of the first and second bracket members 62 and 64, to firmly clamp the support assembly 60 to the slotted standards 44, without requiring support from the upper edges of a panel.

After all of the required support assemblies 60 are attached to the associated panel system 20, the counter cap 54 is firmly attached to each of the third bracket members 66 via screws 132. The counter cap 54 is elevated above the upper edge 30 of wire trough 38 by a dimension 162 selected to enable the panel cap 42 to be removed and allow wires to be laid into the wire trough 38, or removed therefrom, as desired. This desirable arrangement has been achieved without sacrificing positional accuracy and structural stability of the counter cap assembly.

We claim:

1. A space dividing panel system, comprising:

a plurality of panels, each of said panels having first and second major sides, and a periphery which includes upper and lower edges and first and second side edges, means joining predetermined side edges of said plurality of panels, a slotted standard accessible between adjacent panels, with each slotted standard having first and second columns of vertically spaced slots respectively accessible from the first and second sides of the panels, a counter cap, support means, including at least one support assembly, with said at least one support assembly supporting said counter cap in vertically spaced relation above the upper edge of at least one of the panels, said at least one support assembly including first and second vertically oriented elongated bracket members having first and second ends, and a horizontally oriented third bracket member, said first and second bracket members including mounting means adjacent to their first ends respectively engaging the first and second columns of a slotted standard, with the second ends extending upwardly, said third bracket member being supported by the second ends of the first and second bracket members, means fixing the first and second vertically oriented bracket members to the horizontally oriented third bracket member, and means fixing the counter cap to said horizontally oriented third bracket member.

2. The space dividing panel system of claim 1 wherein the mounting means of each of the first and second bracket members includes an L-shaped clip having hookshaped connectors disposed in slots of a slotted standard.

3. The space dividing panel system of claim 1 wherein at least certain of the panels include a wire trough accessible via the upper edge of the panel, with the vertically spaced relation between the counter cap and upper panel edge being selected to enable wires to be placed in, and removed from, said wire trough without disturbing the counter cap and the at least one support assembly.

4. The space dividing panel system of claim 1 wherein the wire trough includes a panel cap, with the vertically spaced relation between the counter cap and upper edge being selected to enable the panel cap to be positioned and removed, without disturbing the counter cap and the at least one support assembly.

5. The space dividing panel system of claim 1 wherein the support means includes a second support assembly, horizontally spaced from the at least one support assembly, with said second support assembly engaging another of the slotted standards.

6. The space dividing panel system of claim 1 wherein the horizontally oriented third bracket member is elongated, having first and second ends and a channel shaped cross-sectional configuration which includes a horizontally oriented bight and first and second leg portions.

7. The space dividing panel system of claim 6 wherein the first and second leg portions of the horizontally oriented third bracket member have a substantially crescent shaped configuration, and wherein the length of each leg portion smoothly increases from a minimum dimension adjacent to the first and second ends to a maximum dimension intermediate the first and second ends.

* * * * *